United States Patent [19]

Drewsen

[11] Patent Number: 4,665,890

[45] Date of Patent: May 19, 1987

[54] HEATING SYSTEM

[76] Inventor: Philip L. Drewsen, Rte. 3, Box 419BN, Cottonwood, Calif. 96022

[21] Appl. No.: 803,678

[22] Filed: Dec. 2, 1985

[51] Int. Cl.[4] ..... F24C 1/14

[52] U.S. Cl. ..... 126/77; 237/55; 237/52

[58] Field of Search ..... 237/55, 52, 50, 47; 165/901; 126/69, 77, 307 R, 307 A, 79, 67, 74, 75, 83

[56] References Cited

U.S. PATENT DOCUMENTS 4,320,738 3/1982 Johnson ..... 237/55

*Primary Examiner*—Henry A. Bennet

*Attorney, Agent, or Firm*—Leonard D. Schappert

[57] ABSTRACT

A heating system designed to extract more than the usual amount of heat from a given amount of fuel by controlling the route of smoke from a firebox through a smoke duct over a tortuous path and exposing the walls of the smoke duct to ambient air, thereby increasing the efficiency of the heating system.

10 Claims, 10 Drawing Figures

HEATING SYSTEM

BACKGROUND OF THE INVENTION

1. Field of the Invention

This invention relates generally to fuel burning stoves and fireplaces and, more specifically, to a heating device designed to route the smoke created in burning through a baffle network, thereby providing more available heat extraction surfaces, extracting more heat therefrom and increasing efficiency of the heating device.

2. Description of the Prior Art

Because of recent energy shortages specifically relating to oil and natural gas, heating units designed to be utilized with renewable and/or readily available energy sources, such as wood and coal, are becoming more popular as primaary and secondary sources for heating buildings. Such stoves generally consist of a firebox with a door in the front or on the side or top of the firebox, and with a flue and a damper inside the flue at the top of the stove. In the combustion process, heat is absorbed by the stove walls and radiated therefrom into the area to be heated. While some stoves have utilized baffles near the top of the stove to permit final burning of exhaust gases before they enter the flue, such units have not increased the heat radiating surfaces of the stove accordingly. Applicant is unaware of any prior art which combines the unique baffle arrangement of the present invention with a duct arrangement of the unique sort found in the present invention.

SUMMARY OF THE INVENTION

The present invention consists of a heating system designed to extract more heat from a given amount of fuel by routing smoke and gases from a flame inside the firebox over a tortuous path, and provides radiation surface over much of the tortuous path, thereby increasing the efficiency of the heating system. The heating system may be designed as a unitary stove, a ducting attachment for existing stoves, a fireplace insert, or any other convenient form which accomplishes the desired result.

One of the objects of the present invention is to provide a heating system which, because of its design, extracts more heat from a given amount of fuel than is normally realized, thereby increasing the efficiency of the heating system.

Another object of the present invention is to provide an unique heating system which includes duct work which, under specific conditions, routes the smoke from a firebox over a tortuous path, thereby extracting more heat from the gases before the smoke exits the flue.

A further object of the present invention is to provide a heating system having more than the usual heat exchange surface area exposed to ambient air to increase the efficiency of heat transfer.

A further object of the present invention is to provide a heating system having features which are readily adaptable to create a unitary stove, an external adapter for use with an existing stove, and a fireplace insert, each having virtually identical features which conduct smoke from the firebox in such a way that considerably more heat is extracted therefrom before the smoke exits the flue, and further providing for a greater heat exchange surface area than is normally provided in heating units of this type.

The foregoing objects, as well as other objects and benefits of the present invention, are made more apparent by the descriptions and claims which follow.

DESCRIPTION OF THE PREFERRED EMBODIMENTS

Figure 3:
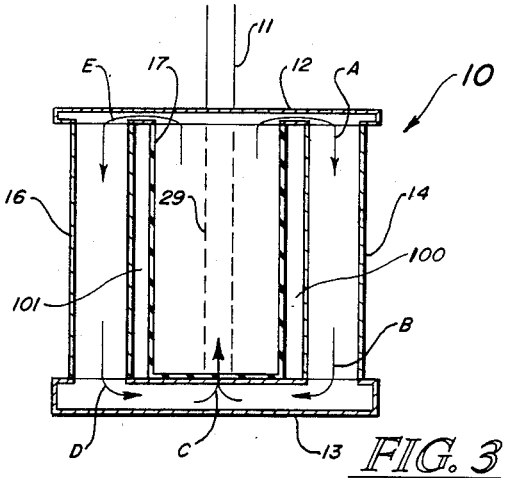
FIG. 3 is a cross-sectional view of the stove of FIG. 1 taken along lines 3—3 of FIG. 1.
Figure 4:
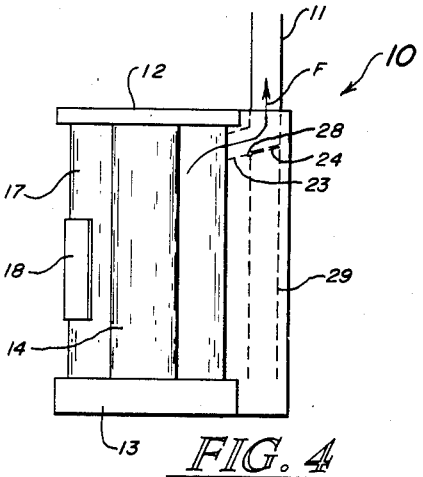
FIG. 4 is side view of the stove shown in FIG. 1, showing the path of smoke when a fire is started.
Figure 5:
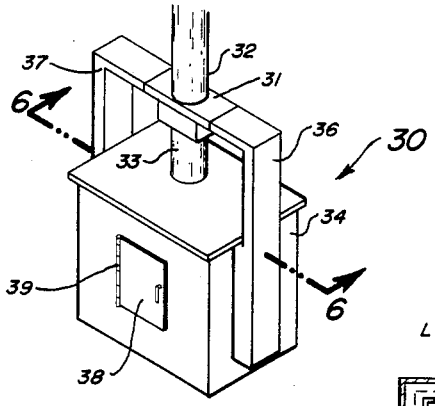
FIG. 5 is a perspective view of an alternate embodiment of the invention showing an adapter positioned on a stove and designed to increase efficiency of the stove.
Figure 6:
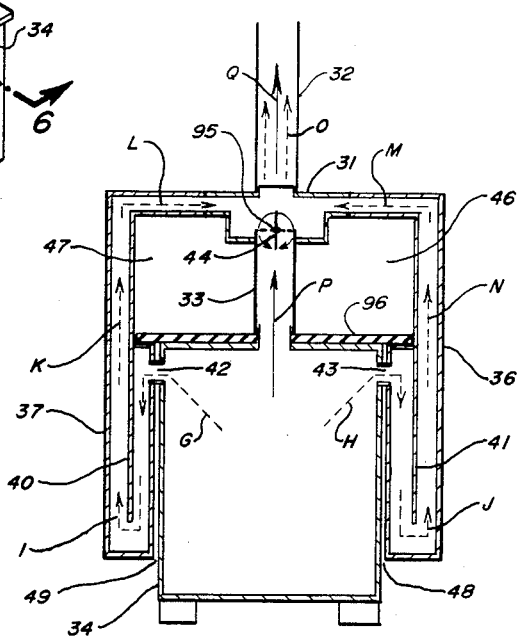
FIG. 6 is a cross-sectional view of the stove and adapter of FIG. 5 taken along lines 6—6 of FIG. 5.
Figure 7:
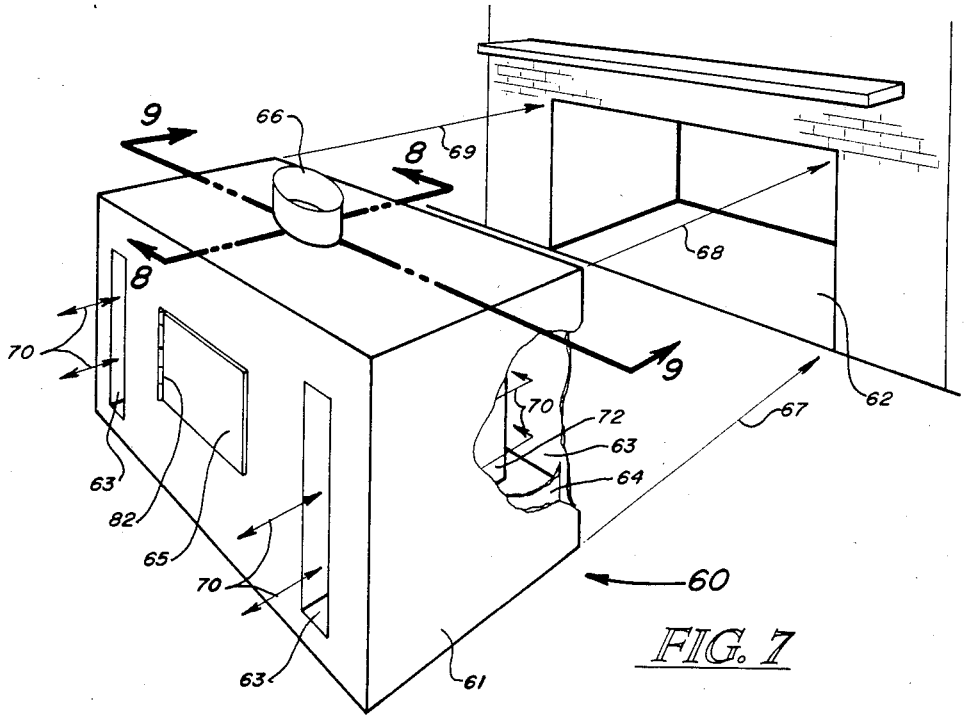
FIG. 7 is a perspective view of a fireplace insert utilizing the features of the present invention.
Figure 8:
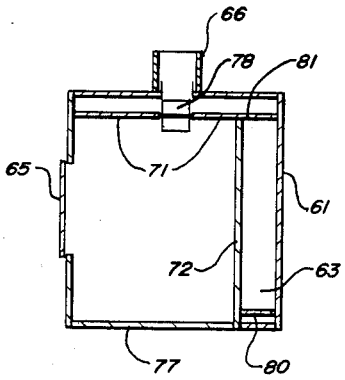
FIG. 8 is a cross-sectional view of the fireplace insert shown in FIG. 7 taken along lines 8—8 of FIG. 7.
Figure 9:
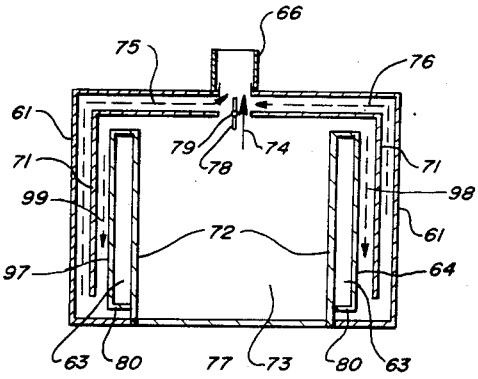
FIG. 9 is a cross-sectional view of the fireplace insert of FIG. 7 taken along lines 9—9 of FIG. 7, and showing the path which smoke follows during alternative modes of operation.

While the present invention consists of a heating system having features which allow smoke to be routed over a tortuous path and providing greater than the usual heaat exchange surface area, applicat envisions three major embodiments: a unitary stove as shown in FIGS. 1 through 4, an adapter for use with existing stoves and shown in FIGS. 5 and 6, and a fireplace insert shown in FIGS. 7 through 9 of the drawings.

THE STOVE

Figure 1:
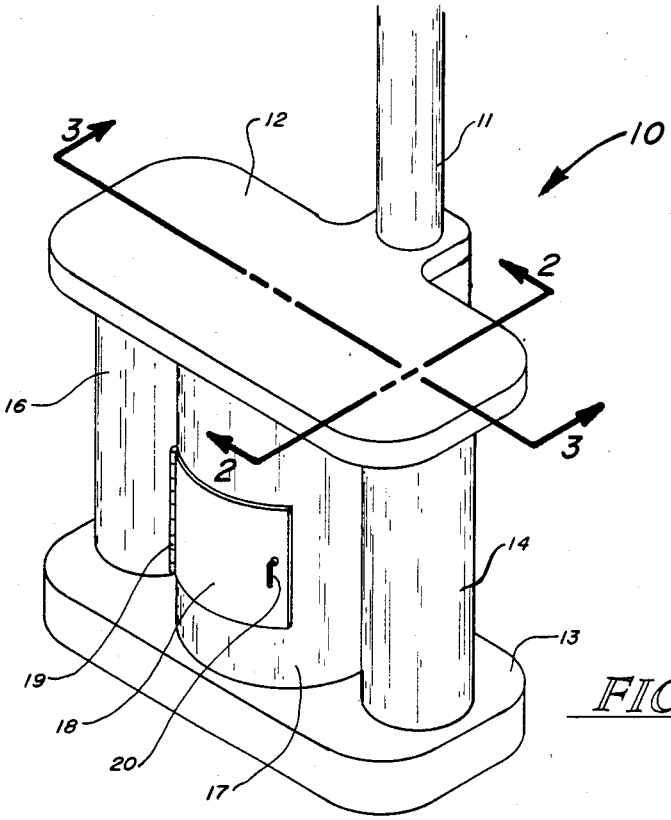
FIG. 1 is a perspective view of the present invention embodied in a stove.

FIG. 1 of the drawings is a perspective view of stove 10 utilizing the embodiments of the present invention. Stove 10 consists of a firebox 17 with a door 18 hingedly attached with hinges 19, and having a handle 20 for despositing wood or other fuel therein, and further including smoke ducts 14 and 16, through which smoke may be routed in order to extract more heat therefrom, and which expose considerable heat exchange surface area to ambient air. Stove 10 further includes a top 12 and a flue 11 extending therefrom.

Figure 2A:
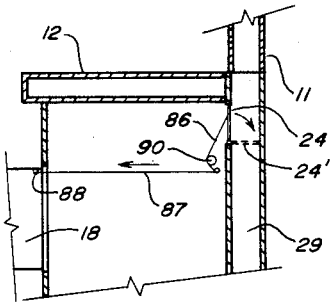
FIG. 2A is an operational view showing a safety mechanism designed to prevent smoke from exiting the door of the stove when the door is open.
Figure 2:
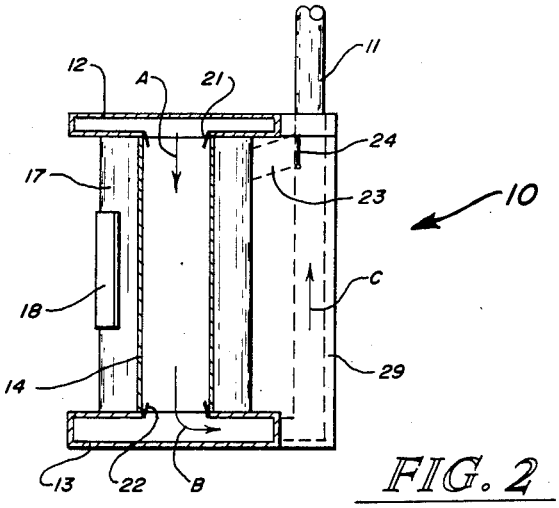
FIG. 2 is a cross-sectional view of the stove shown in FIG. 1 taken along lines 2—2 of FIG. 1.

FIGS. 2, 3 and 4 show the operation of stove 10. When heat control 24 is closed as shown in FIG. 2, it prevents smoke from exiting firebox 17 through opening 23 to flue 11, and forces the smoke through the open area 99 of top 12 as shown by arrows A and E, down through smoke ducts 14 and 16 into hollow base 13 as shown by arrows B and D, through the back of hollow base 13 to the rear smoke duct 29 as shown by arrows C, and therefrom out through flue 11. Ducts 14 ad 16 are separated from firebox 17 by open areas 100 and 101 as shown in FIG. 3, and the surface are generally exposed to the ambient air to increase the amount of heat extracted from stove 10. When heat control 24 is positioned as shown in FIG. 4, closing off rear smoke duct 29, smoke flows directly from firebox 17 through opening 23 as shown by arrow F, and up through flue 11.

While such is not shown specifically in the drawings, heat control 24 may be positioned by a hand control extending therefrom. When a fire is being started in firebox 17 of stove 10, heat control 24 is positioned as shown in FIG. 4, closing off rear smoke duct 29, causing smoke to exit through opening 23 to flue 11 and reducing the likelihood that smoke will back up through door 18 of stove 10. If heat control 24 were positioned as shown in FIG. 2, closing off the direct smoke path between firebox 17 and flue 11, smoke would flow as noted earlier up through rear smoke duct 29 and, without durther precautions, if door 18 were opened with heat control 24 in this position, smoke would billow out door 18. For this reason, the safety device shown in FIG. 2A or a similar appropriate device is installed in stove 10. The safety device of FIG. 2A automatically adjusts heat control 24 to the position shown in FIG. 4 when door 18 is opened. The safety device designed to keep smoke from backing up into a room consists of a cable 87 attached to door 18 by eyelet 88 and, at its other end, attached to a spring 86, which is pivotally attached to firebox 17 by pin 90. When door 18 is opened, it pulls on cable 87, pulling on the end of spring 86 and pushing heat control 24 down to the position shown in dashed lines 24' of FIG. 2A. While a cable-and-spring arrangement was used herein as a safety precaution to prevent smoke from backing up into a room, any safety system capable of changing the position of heat control 24 when door 18 is opened would be acceptable.

THE ADAPTER

FIGS. 5 and 6 of the drawings show an adapter for use with existing stoves. Specifically, FIG. 5 is a perspective view of an existing stove with an adapter utilizing the features of the present invention attached thereto. In this embodiment, heating unit 30 consists of a stove firebox 34 with a door 38 hingedly attached thereto by hinge 39, with stove firebox 34 modified to accept smoke ducts 36 and 37 and adapter 31 as shown. Adapter 31 is positioned within the flue line between flue 33 and flue 32.

FIG. 6 is a cross-sectional view of the stove and adapter 31 taken along lines 6—6 of FIG. 5, showing the internal structure thereof. Adaptation of stove firebox 34 to accept adapter 31 and smoke ducts 36 and 37 includes cutting smoke exit holes 42 and 43 in stove firebox 34 and attaching smoke ducts 36 and 37 by any acceptable attaching means which allow air to circulate through circulation openings 48 and 49. Adapter 31 includes a heat control 44 pivotally positioned on pin 95 so that it controls the flow of air and smoke through flue 33 and into adapter 31. When heat control 44 is positioned as shown by the solid line in FIG. 6, smoke flows directly from stove firebox 34 through flue 33 into adapter 31 and into flue 32 as shown by arrows P and Q. When heat control 44 is positioned as shown by the dashed lines, flow of smoke and air is cut off from flue 33; therefore, smoke is diverted through exit holes 42 and 43 as shown by arrows G and H, and down through smoke ducts 36 and 37 as shown by arrows I, J, K, L, M and N into adapter 31 and up through flue 32 as shown by arrows O. Extensions 40 and 41 inside smoke ducts 36 and 37 are provided to force smoke to travel over a longer distance, thereby increasing the amount of heat extracted as a result of air flow through circulation openings 46, 47, 48 and 49. Smoke ducts 36 and 37 are rigidly attached to top 96 by welding or any other acceptable means to hold them rigidly in position with respect to stove firebox 34. Though not shown specifically in this embodiment, the use of a safety device comparable to that of FIG. 2A, designed to open heat control 44 when door 38 is opened, is contemplated with adapter 30.

THE FIREPLACE INSERT

FIG. 7 shows a perspective view of a fireplace insert 60 in position to be inserted into fireplace 62 along arrows 67, 68 and 69.

FIG. 8, taken along lines 8—8 of FIG. 7, and FIG. 9, taken along lines 9—9 of FIG. 7, are cross-sectional views showing the internal structure of fireplace insert 60 and showing air duct 63 and smoke paths in greater detail.

Fireplace insert 60 consists of a body 61 with a firebox 73 therein and with air duct 63 extending around firebox 73, providing for extraction of heat from the walls 72 of firebox 73. Air flows through air duct 63 along arrows 70 as shown. Fireplace insert 60 further has a door 65 attached thereto by hinge 82 for inserting fuel therein, and has a flue 66 on the top thereof. More specifically, as shown in FIGS. 7, 8 and 9, it can be seen that heat control damper 78 is provided to control the path of smoke so that, when heat control damper 78 is in an open condition as shown in FIG. 9, smoke flows from firebox 73 along arrow 74, directly into flue 66. When heat control damper 78 is closed, inhibiting flow of smoke from firebox 73 along arrow 74, smoke is forced into the smoke ductwork created by body 61 and walls 64, 71 and 97, flowing along the path shown by dashed arrow lines 75, 76, 98 and 99 to flue 66. As a result of the smoke being forced to flow along these lines and the air flowing around firebox 73 through air duct 63, more heat is extracted than would otherwise be. Heat control damper 78 is normally left in the open position shown in FIG. 9 for purposes of starting fires, and closed to force smoke along arrows 75, 76, 98 and 99 only after a fire is burning. Heat control damper 78 is pivotally attached to wall 71 by pivot pin 79. Although not shown specifically in this embodiment, the use of a safety device comparable to that of FIG. 2A, designed to open heat control damper 78 when door 65 is opened, is contemplated with fireplace insert 60.

While different embodiments of the present invention have been disclosed herein, including a stove, an adapter for use with an existing stove and a fireplace insert, all of the embodiments utilize cmmon features. And although applicant has taught specific means of accomplishing the invention, others skilled in the art of heating unit design will see obvious improvements and modifications which may be made. It is applicant's intention that changes and variations may be made without departure from the spirit or scope of the following claims, and this disclosure is not intended to limit applicant's protection in any way.

I claim:

1. A heating system comprising:

a firebox having a top end and a bottom end;

a flue connected to and communicating with said firebox near said top end of said firebox and extending downward to a point near said bottom end of said firebox;

a heat control for controlling the direct passage of smoke and gases between said firebox and said flue, and smoke duct means positioned outside said firebox, having a top end and a bottom end, said top end of said smoke duct means connected to and communicating with said top end of said firebox and said bottom end of said smoke duct means connected to and communicating with said flue near said bottom end of said firebox so that smoke passes downward therethrough when said heat control is positioned to limit direct passage of smoke between said firebox and said flue and further having walls exposed to ambient air to extract heat from smoke and gases flowing therethrough, thereby increasing efficiency.

2. The invention of claim 1, wherein said firebox includes a door for despositing fuel therein and a safety mechanism attached between said door and said heat control so that, when said door is opened, said safety mechanism positions said heat control so that smoke and gases pass directly from said firebox to said flue.

3. The invention of claim 1, wherein said firebox, said heat control and said smoke duct means are constructed as an integrated unitary stove for ease of installation.

4. The invention of claim 2, wherein said firebox, said heat control and said smoke duct means are constructed as an integrated unitary stove for ease of installation.

5. The invention of claim 1, wherein said firebox is constructed of an existing stove and said heat control and said smoke duct means are constructed so that they communicated with and are attachable to said firebox, and including attaching means for attaching said heat control and said smoke duct means to said firebox.

6. The invention of claim 2, wherein said firebox is constructed of an existing stove and said heat control and said smoke duct means are constructed so that they communicate with and are attachable to said firebox, and including attaching means for attaching said heat control and said smoke duct means to said firebox.

7. The invention of claim 1, wherein said firebox, said heat control and said smoke duct means are constructed as an integrated unitary fireplace insert for use in existing fireplaces.

8. The invention of claim 2, wherein said firebox, said heat control and said smoke duct means are constructed as an integrated unitary fireplace insert for use in existing fireplaces.

9. The invention of claim 1, wherein said smoke duct means is constructed so that the surface of said walls exposed to ambient air forms an air duct increasing efficiency of heat transfer when air flows through said air duct.

10. A heating system for use with an existing firebox having a top end and a bottom end, a flue opening and an alternative smoke path opening, comprising:

an adapter having:

a first opening for attaching to said flue opening in said existing firebox;

a second opening for attaching to a flue;

a third opening, and a heat control for controlling flow of smoke and gases between said first opening and said second opening, and smoke duct means positioned outside said existing firebox communicating with said alternative smoke path opening of said existing firebox and said third opening in said adapter and having walls which force smoke entering through said alternative smoke path opening downward to a level near said bottom end of said firebox, then upward to said third opening in said adapter when said heat control is positioned to limit direct passage of smoke and gases between said first opening and said second opening of said heat control, whereby efficiency of said existing firebox is enhanced.

* * * * *